US006378943B1

(12) United States Patent
Beggs et al.

(10) Patent No.: US 6,378,943 B1
(45) Date of Patent: Apr. 30, 2002

(54) CHAIR TILT LOCK MECHANISMS

(75) Inventors: Ken A. Beggs; Gerard J. Matern, both of Waterloo (CA)

(73) Assignee: Northfield Metal Products Ltd., Waterloo (CA)

( * ) Notice: Subject to any disclaimer, the term of this patent is extended or adjusted under 35 U.S.C. 154(b) by 0 days.

(21) Appl. No.: 09/277,484

(22) Filed: Mar. 26, 1999

(51) Int. Cl.[7] ..... A47C 1/02

(52) U.S. Cl. ..... 297/325; 297/301.7; 297/302.7; 297/326

(58) Field of Search ..... 297/325, 328, 297/327, 360.8, 302.1, 301.7, 302.7, 326

(56) References Cited

U.S. PATENT DOCUMENTS

| | | | | |
|---|---|---|---|---|
| 3,480,249 | A | 11/1969 | Lie | 297/328 |
| 3,975,050 | A | 8/1976 | McKee | 297/328 |
| 4,101,167 | A | 7/1978 | Örnberg | 297/328 |
| 4,328,943 | A | 5/1982 | Eldon, III | |
| 4,384,741 | A | 5/1983 | Flum et al. | |
| 4,555,085 | A | 11/1985 | Bauer et al. | |
| 4,664,445 | A | 5/1987 | Groseth | |
| 4,892,354 | A | 1/1990 | Estkowski et al. | |
| 4,911,501 | A | 3/1990 | Decker et al. | 297/300.8 |
| 4,938,531 | A | 7/1990 | Fogarassy | |
| 4,948,198 | A | 8/1990 | Grossman et al. | |
| 5,018,787 | A | 5/1991 | Estkowski et al. | |
| 5,066,069 | A | 11/1991 | DeGelder | |
| 5,080,434 | A | 1/1992 | Locher | 297/300.8 |
| 5,259,663 | A | 11/1993 | Ambasz | 297/302 |
| 5,417,474 | A | 5/1995 | Golynsky | |
| 5,423,595 | A | 6/1995 | Hancock | 297/374 |
| 5,577,807 | A | 11/1996 | Hodge et al. | 297/300.8 |
| 5,683,139 | A | 11/1997 | Golynsky et al. | 297/302.3 |
| 5,762,399 | A | 6/1998 | Liu | 297/302.7 |
| 5,997,087 | A | 12/1999 | Stumpf | |

FOREIGN PATENT DOCUMENTS

| | | |
|---|---|---|
| GB | 0 382 052 | 10/1932 |

*Primary Examiner*—Anthony D. Barfield
(74) *Attorney, Agent, or Firm*—Wood, Herron & Evans, LLP

(57) ABSTRACT

A chair seat tilt lock mechanism has a detent to latch an actuating lever in a locked and unlocked position. When the lever is moved to a locking position, a spring urges a moveable locking member toward a locking position, however, the moveable locking member only moves to its locking position when the chair is tilted to properly register the moveable locking member with a fixed locking member. When the lever is moved to an unlocking position, another spring urges the moveable locking member to an unlocking position. The moveable locking member may be a slider which slides under a fixed abutment to lock the chair from tilting. Alternatively, the moveable locking member may be a pivoting arm with a series of openings which may receive the forked end of a tongue in a locked position.

26 Claims, 10 Drawing Sheets

CHAIR TILT LOCK MECHANISMS

CROSS REFERENCE TO RELATED APPLICATIONS

This application is related to application Ser. No. 08/922,138 and application Ser. No. 09/143,130, both assigned to Northfield Metal Products Ltd.

FIELD OF THE INVENTION

This invention relates to chair tilt lock mechanisms and to chairs comprising such lock mechanisms.

BACKGROUND OF THE INVENTION

It is typical in office chairs for the seat to tilt rearwardly as an occupant leans back in the seat. Other chairs, such as chairs for typing, are designed so that the seat tilts forwardly when an occupant leans forward in a chair. However, sometimes the occupant does not wish the seat to tilt when leaning forwardly or rearwardly. To accommodate such an occupant preference, chairs have been designed with tilt lock mechanisms.

U.S. Pat. No. 4,555,085 issued Nov. 26, 1985 to Bauer et al. discloses a chair seat tilt lock mechanism. A horizontal slider slides between a position whereat a bolt extending through the slider blocks the base plate of the seat and, therefore, prevents the seat from tilting and another position whereat the bolt is registered with an opening through the base plate. The slider is moved by an operating arm which is secured to it.

The subject invention seeks to provide improved chair seat tilt lock mechanisms.

SUMMARY OF THE INVENTION

According to the present invention, there is provided a chair tilt lock mechanism, comprising: a chair seat post support; a chair seat bracket tiltably mounted to said chair seat post support; a first locking member extending from one of said chair seat post support and said chair seat bracket; a second locking member mounted on another of said chair seat post support and said chair seat bracket and moveable between a locking position whereat said first locking member and said second locking member prevent said chair seat bracket from tilting with respect to said chair seat post support and an unlocking position whereat said first locking member and said second locking member permit said chair seat bracket to tilt with respect to said chair seat post support; an actuator for moving said second locking member; and a detent for latching said actuator.

According to another aspect of the present invention, there is provided a chair tilt lock mechanism, comprising: a chair seat post support; a chair seat bracket tiltably mounted to said chair seat post support; a first locking member extending from one of said chair seat post support and said chair seat bracket; a second locking member mounted on another of said chair seat post support and said chair seat bracket and moveable between a locking position whereat said first locking member and said second locking member prevent said chair seat bracket from tilting with respect to said chair seat post support and an unlocking position whereat said first locking member and said second locking member permit said chair seat bracket to tilt with respect to said chair seat post support; an actuator for moving said second locking member, said actuator comprising a locking spring arranged so as to urge said second locking member to said locking position, when compressed.

According to a further aspect of the invention, there is provided a chair tilt lock mechanism, comprising: a chair seat post support; a chair seat bracket tiltably mounted to said chair seat post support; a tongue rigidly extending from one of said chair seat post support and said chair seat bracket; an arm having at least one tongue receiving opening mounted on another of said chair seat post support and said chair seat bracket and moveable between a locking position whereat said tongue and said arm prevent said chair seat bracket from tilting with respect to said chair seat post support and an unlocking position whereat said tongue and said arm permit said chair seat bracket to tilt with respect to said chair seat post support; and an actuator for moving said arm comprising a locking spring arranged for urging said arm to said locking position, when compressed.

According to a further aspect of the invention, there is provided a chair, comprising: a chair seat post; a chair seat tiltably mounted to said chair seat post; a first locking member extending from one of said chair seat post and said chair seat; a second locking member mounted on another of said chair seat post and said chair seat and moveable between a locking position whereat said first locking member and said second locking member prevent said chair seat from tilting with respect to said chair seat post and an unlocking position whereat said first locking member and said second locking member permit said chair seat to tilt with respect to said chair seat post; an actuator for moving said second locking member; and a detent for latching said actuator.

BRIEF DESCRIPTION OF THE DRAWINGS

In the figures which illustrate example embodiments of the invention.

DETAILED DESCRIPTION OF THE PREFERRED EMBODIMENTS

Figure 1:
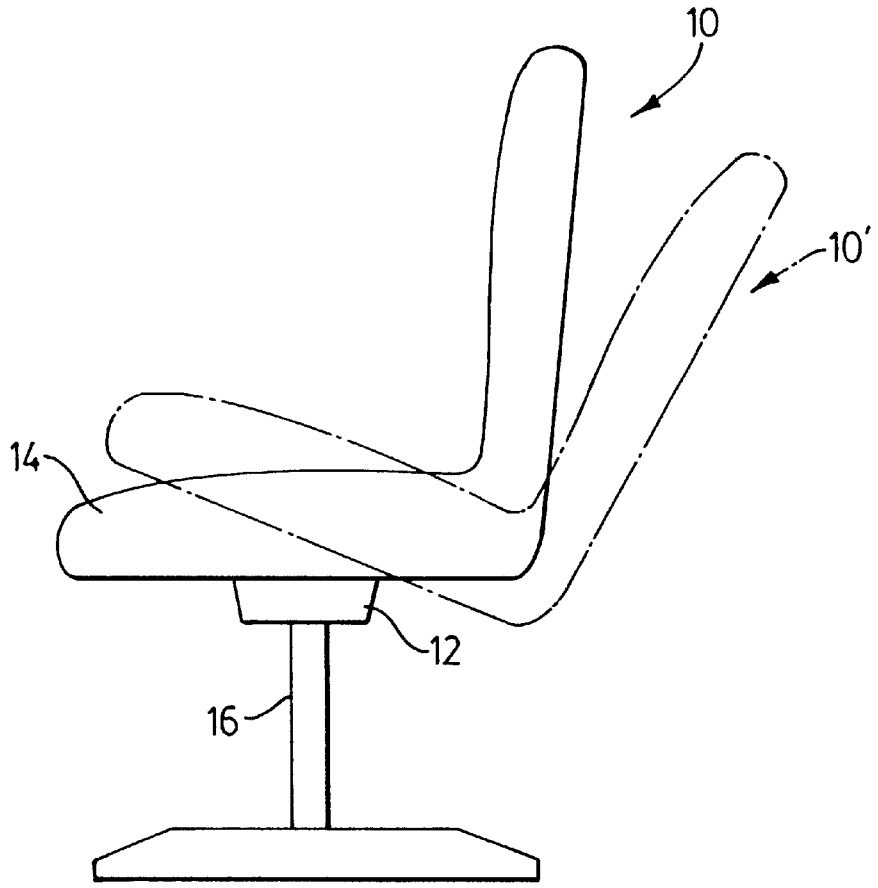
FIG. 1 is a side view of a chair embodying a tilt lock mechanism made in accordance with this invention.

Turning to FIG. 1, a chair 10 has a tilt lock mechanism 12 joining the chair seat 14 to the chair seat post 16. With the chair tilt lock mechanism in an unlocked position, the chair 10 may tilt from a solid line position shown in FIG. 1 to position 10' shown in FIG. 1 in ghost.

Figure 2:
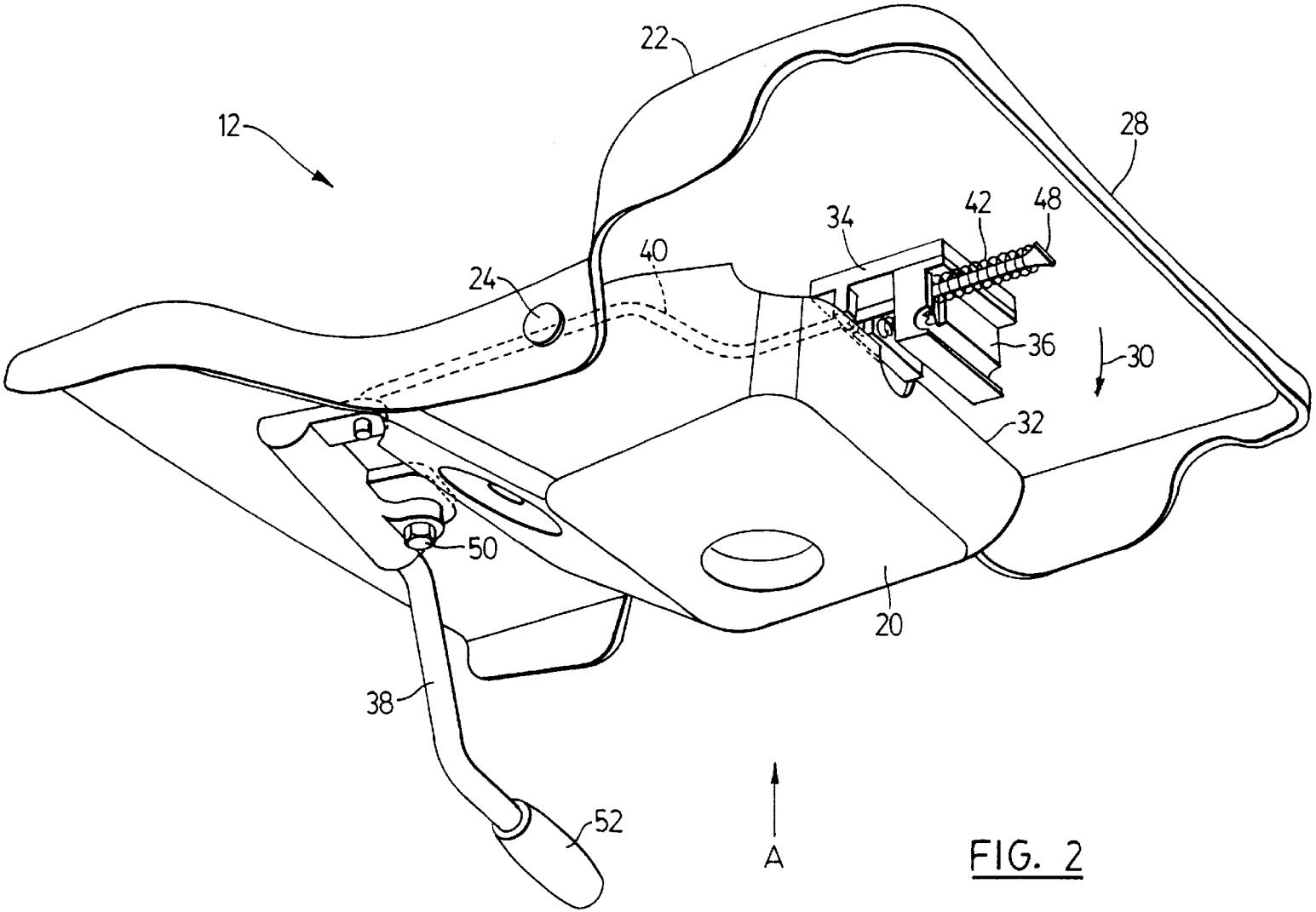
FIG. 2 is a perspective view of a tilt lock mechanism made in accordance with one embodiment of this invention shown in an unlocked position.
Figure 4:
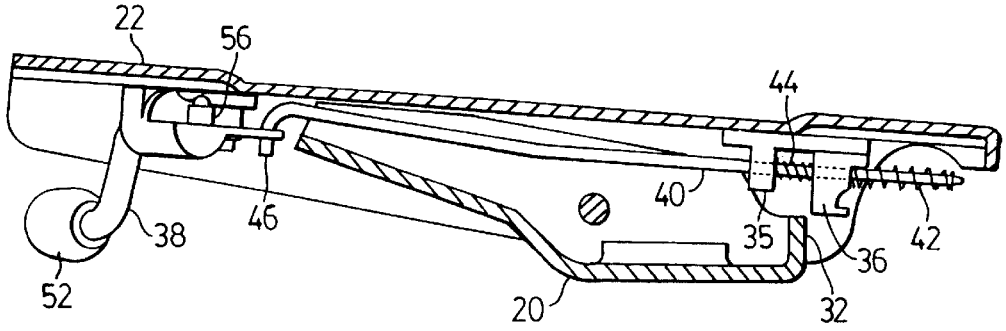
FIG. 4 is a cross-sectional view along the lines 4—4 of FIG. 3.
Figure 3:
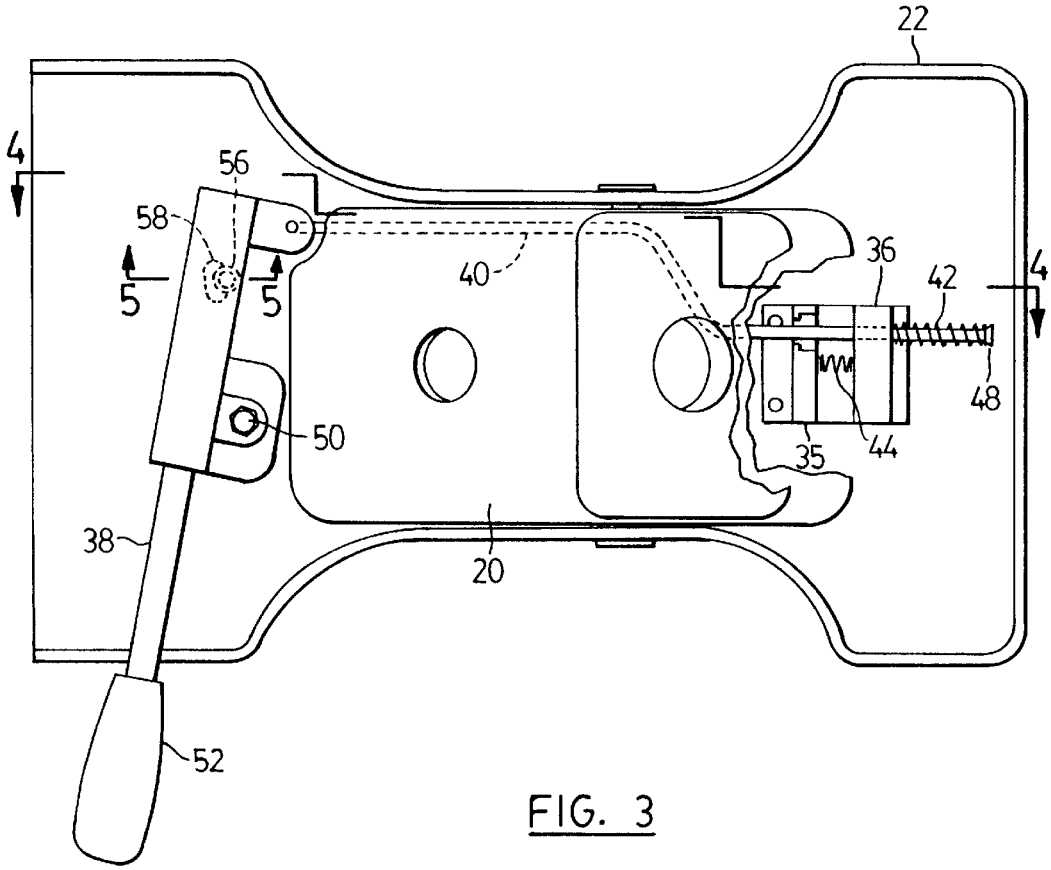
FIG. 3 is a plan view of FIG. 2.

Referring to FIGS. 2 to 4, a tilt lock mechanism 12 for the chair comprises a chair seat post support 20 for supporting seat post 16 (FIG. 1) and a chair seat bracket 22 to which the seat of the chair is affixed. The chair seat bracket 22 is pivotally mounted to the chair seat post support 20 by pivot 24 so that distal portion 28 of the chair seat bracket may tilt in direction 30. A first locking member, namely abutment 32, rigidly extends from the chair seat post support 20. A track 34 is mounted to the chair seat bracket 22 and a second locking member, namely slider 36 is slidably received by track 34.

An actuator comprises a lever 38, a link arm 40, a locking spring 42 and an unlocking spring 44 (seen in FIGS. 3 and 4). The link arm has a finger 46 which pivotably joins the link arm to the lever; the link arm extends through a hole in slider 36 and terminates in an enlarged flange 48. Flange 48 acts as a backstop for locking spring 42 such that the spring, which surrounds the link arm, is sandwiched between flange 48 and slider 36. Unlocking spring 44 is sandwiched between a depending leg 35 of track 34 and slider 36 (and preferably both the depending leg and slider have wells which receive the ends of spring 44 to maintain it in position). The lever 38 is pivotally mounted by pivot 50 to the chair seat bracket 22. A handle 52 is attached to the lever.

Figure 5:
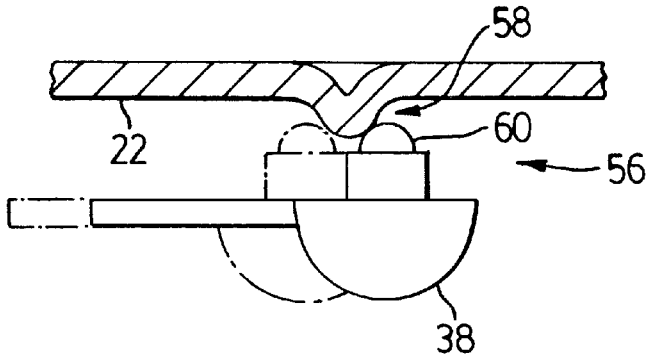
FIG. 5 is a cross-sectional fragmentary view along the lines 5—5 of FIG. 3.

Referencing FIGS. 3 to 5, a detent 56 extends from the lever 38 in opposition to a protrusion 58 extending from the chair seat bracket 22. The detent comprises a spring-loaded lug 60 such that the protrusion must depress the lug for the lug to pass the protrusion.

Figure 6:
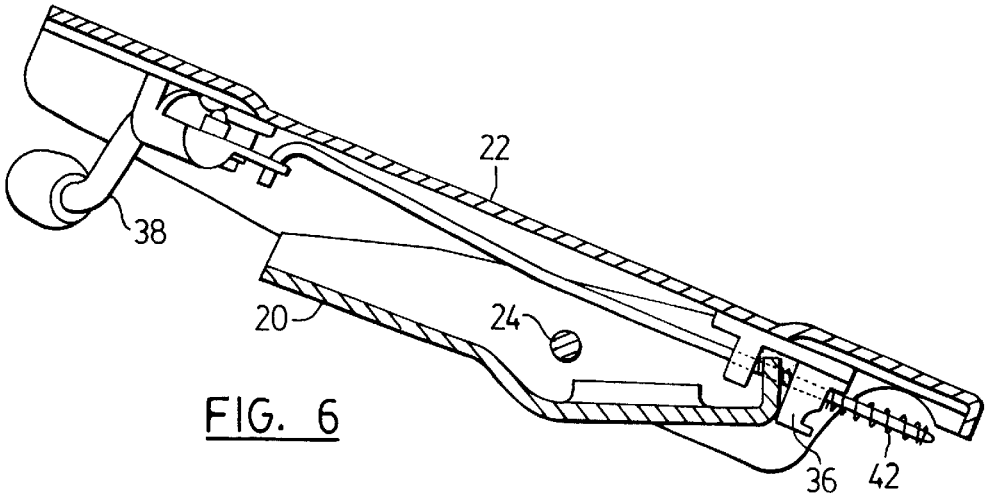
FIG. 6 is a cross-sectional view similar to FIG. 4 but with the chair seat bracket in a tilted position.

With the lever 38 in the unlocking position shown in FIGS. 2 to 4, the link arm 40 is in an extended position relaxing spring 42. In consequence, the slider 36 is urged by unlocking spring 44 to its unlocked position illustrated in these figures whereat the slider is spaced from abutment 32 (an abutment on track 34 may provide a limit stop for slider 36 thereby defining the unlocking position of the slider). In the unlocked position, the chair seat bracket 22 may tilt with respect to the chair post support 20 between the untilted position shown in FIG. 4 and the fully tilted position illustrated in FIG. 6.

Figure 7:
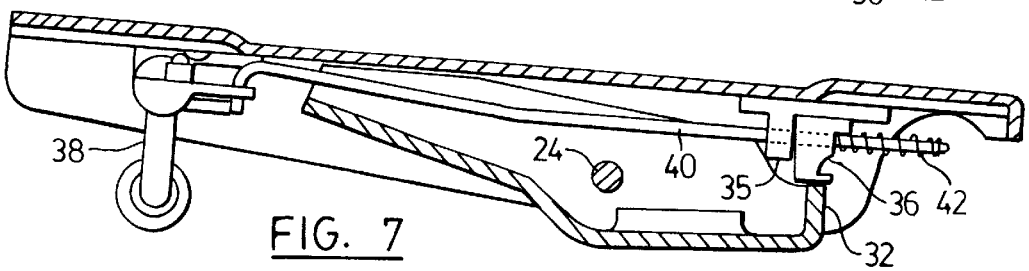
FIG. 7 is a cross-sectional view similar to FIG. 4 but shown with the tilt lock mechanism in a locked position.
Figure 8:
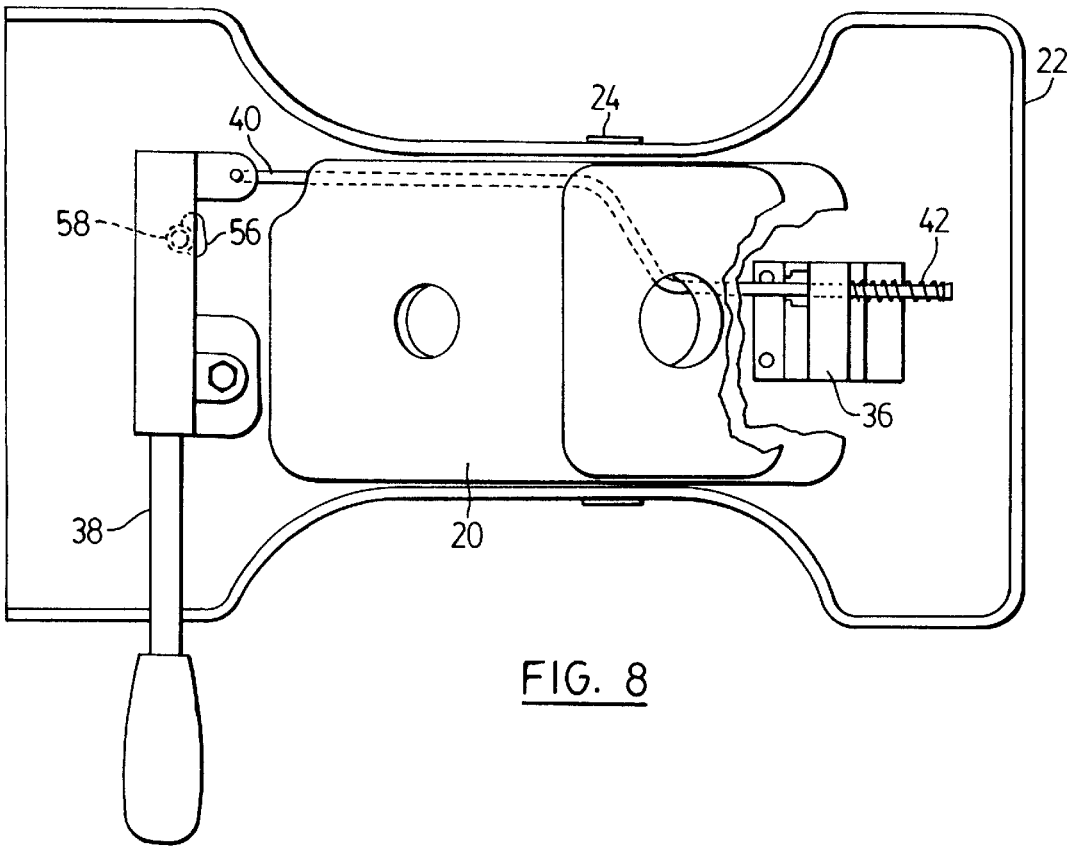
FIG. 8 is a plan view of the tilt lock mechanism of FIG. 2 but shown in a locked position.

When in an untilted or a tilted position, the lever 38 may be pivoted to the locking position shown in FIGS. 7 and 8 by applying sufficient torque to the lever to cause the spring-loaded detent 56 to compress and pass over protrusion 58 on the chair seat bracket. When in the locking position, the link arm 40 is retracted with respect to slider 36 thereby compressing locking spring 42 against the slider so as to urge the slider toward a locking position. The spring constant of locking spring 42 is chosen such that this spring may overcome unlocking spring 44. However, if the seat bracket 22 is in a tilted position, the slider 36 will stop against the side of abutment 32 where it will remain until the seat bracket 22 is brought to the untilted position. Upon the seat bracket 22 reaching the untilted position, the slider clears the side of the abutment and snaps into registration with the top of the abutment under the urging of locking spring 42, as illustrated in FIG. 7. In this position, the distal end 28 of the chair seat bracket is blocked from tilting in direction 30.

Tilt lock mechanism 12 has the advantage that, in view of the detent 56, the lever is latched in an unlocked or a locked position so that the mechanism is unlikely to be accidentally locked or unlocked. Also an occupant has a positive indication of when the lever has been moved sufficiently to reach its locking/unlocking position. Further, an occupant may move lever 38 to its locking position irrespective of whether the chair tilt locking mechanism is in a position to immediately lock. The occupant may also move the lever to an unlocking position when the tilt lock mechanism is locked even where a temporary tilting torque on the chair seat binds the second locking member (slider 36) so as to preclude the second locking member from immediately moving to an unlocking position.

Figure 9:
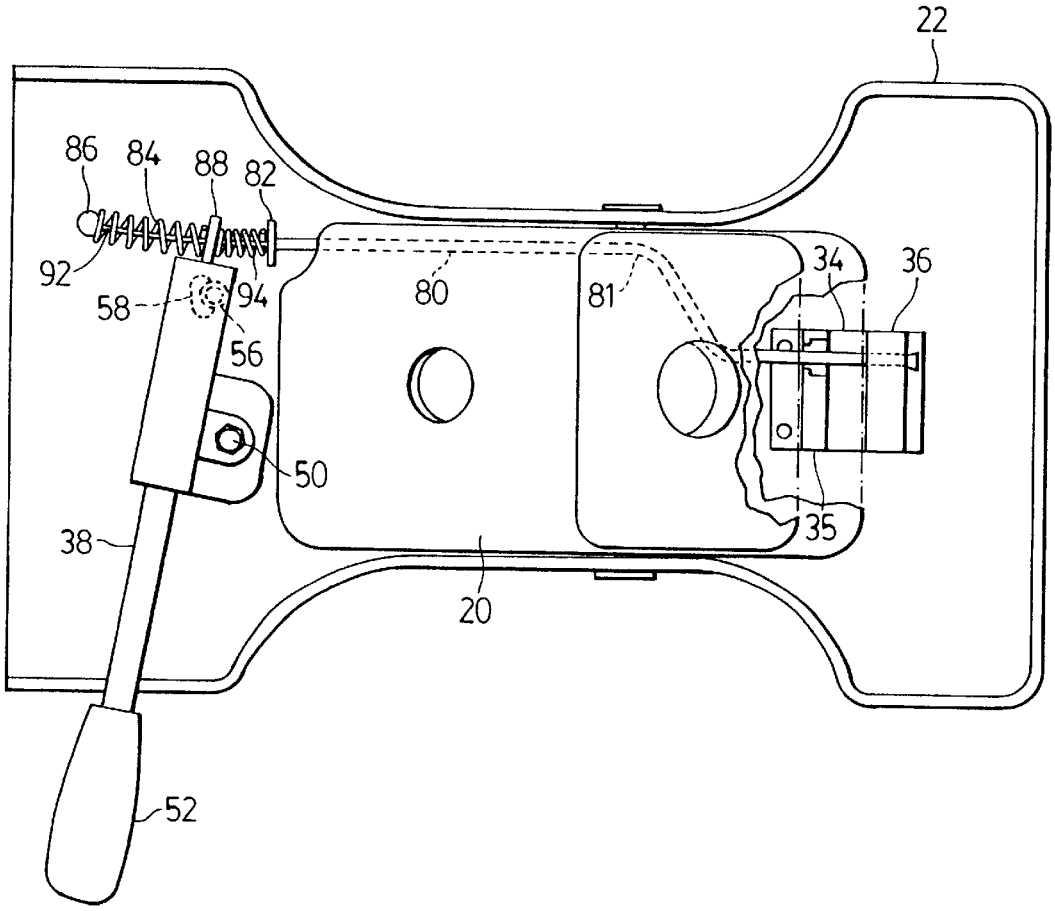
FIG. 9 is a plan view of a tilt lock mechanism made in accordance with another embodiment of this invention shown in an unlocked position.

A modification to the tilt lock mechanism of FIGS. 1 to 8 is shown in FIG. 9. Turning to FIG. 9 wherein like parts have been given like reference numerals, link arm 80 comprises a rod 81 which is affixed at one end to slider 36 in any suitable manner. The other end of rod 81 terminates in a tab 82 from which a wire 84 extends. Wire 84, which is also part of link arm 80, terminates in bulbous end 86. A backstop 88 extending from lever 38 has an opening (not shown) through which wire 84 is received. A locking spring 92 is received by wire 84 and sandwiched between the bulbous end 86 of the wire and backstop 88 of lever 38. An unlocking spring 94 is also received by wire 84 and sandwiched between tab 82 and backstop 88.

In operation, when the lever is moved to the unlocking position shown in FIG. 9, unlocking spring 94 is compressed against backstop 82 and locking spring 92 is relaxed thereby resulting in the link arm 80 urging the slider to move to its unlocking position shown in FIG. 9 whereat the slider is out of registration with the abutment of the chair seat post support. When in the unlocked position of FIG. 9, the lever may be moved to its locked position thereby compressing the locking spring 92 and relaxing the unlocking spring 94 so that the slider 36 is urged by the link arm 80 to a locking position whereat the slider is registered with the abutment.

Another tilt lock mechanism made in accordance with this invention is illustrated in FIGS. 10 to 14. Turning to these figures, wherein like parts have been given like reference numerals, a first locking member is in the nature of a forked tongue 132 rigidly extending from chair post support 20. A second locking member comprises an arm 136 which is pivotably mounted by pivot 170 to chair seat bracket 22 and has a series of tongue receiving openings 172. The locking member arm 136 also has an elongate slot 174 which receives a pin 176 that extends from chair seat bracket 20. The link arm 140 extends through a hole in locking member arm 136 and terminates in an enlarged flange 148. Flange 148 acts as a backstop for locking spring 142 such that the spring, which surrounds the link arm, is sandwiched between flange 48 and locking member arm 136. Unlocking spring 144 also surrounds the link arm and is sandwiched between backstop 178 of the link arm and locking member arm 136.

Figure 10:
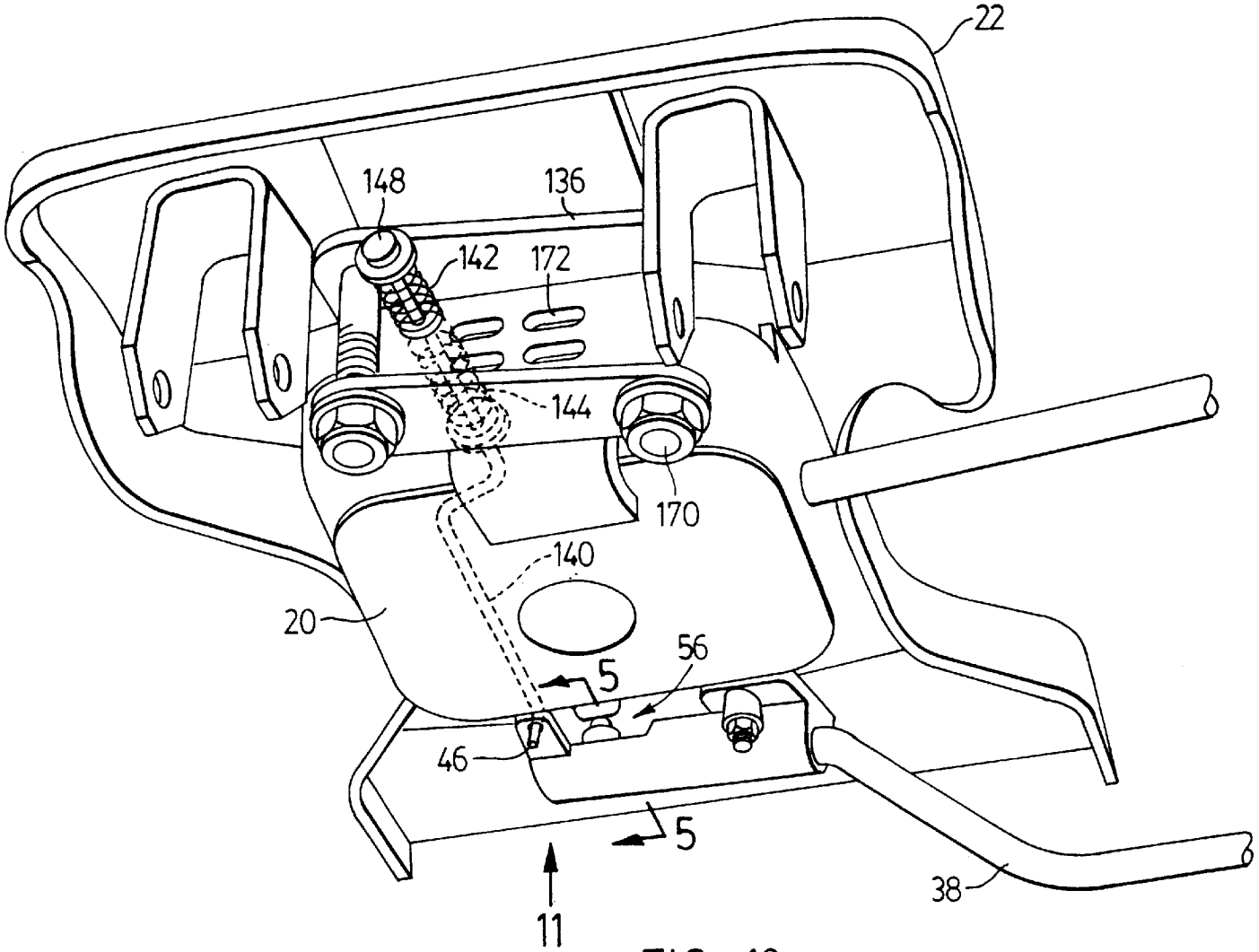
FIG. 10 is a perspective view of a tilt lock mechanism made in accordance with a further embodiment of this invention shown in an locked position.
Figure 11:
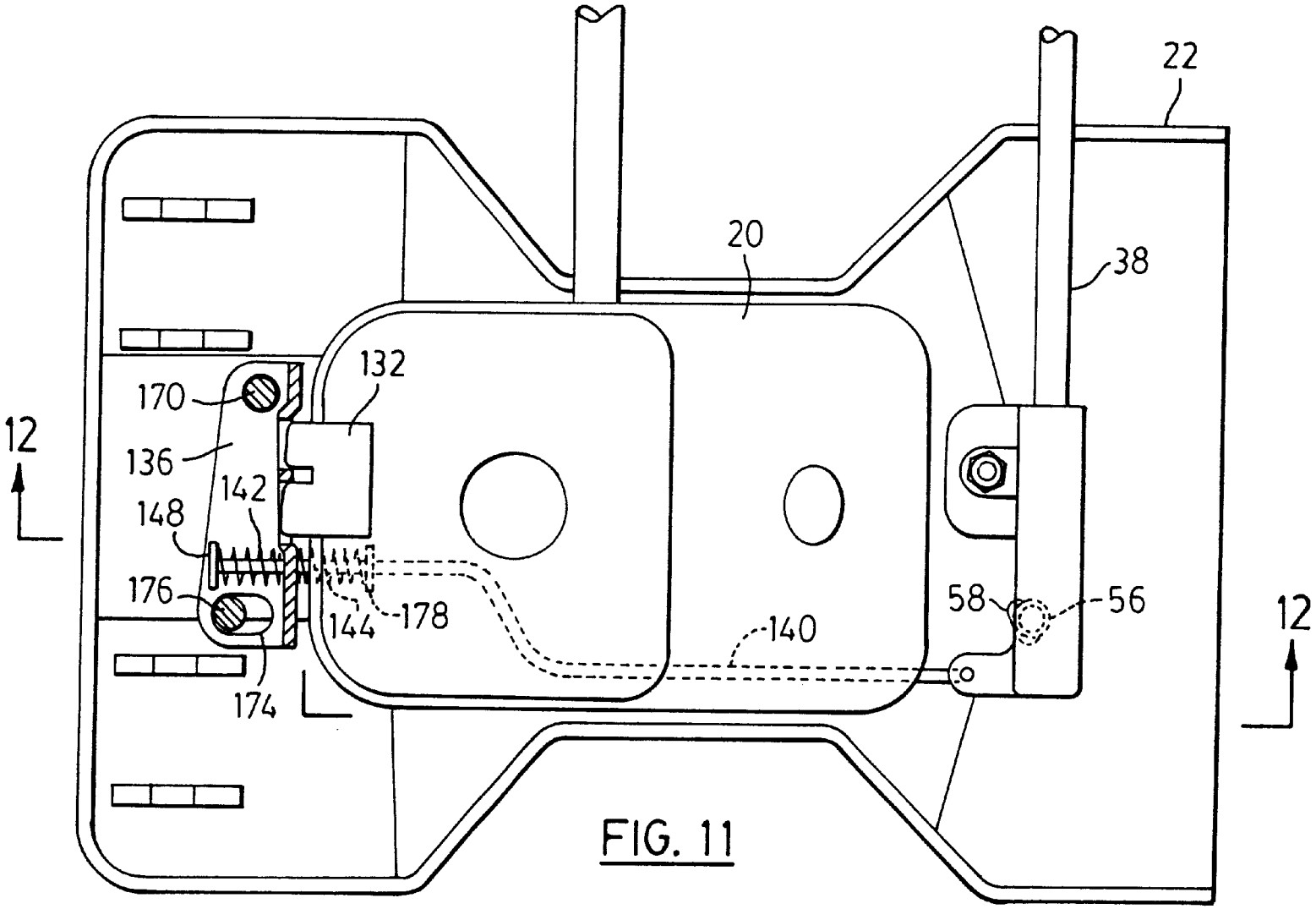
FIG. 11 is a plan view of FIG. 10.
Figure 12:
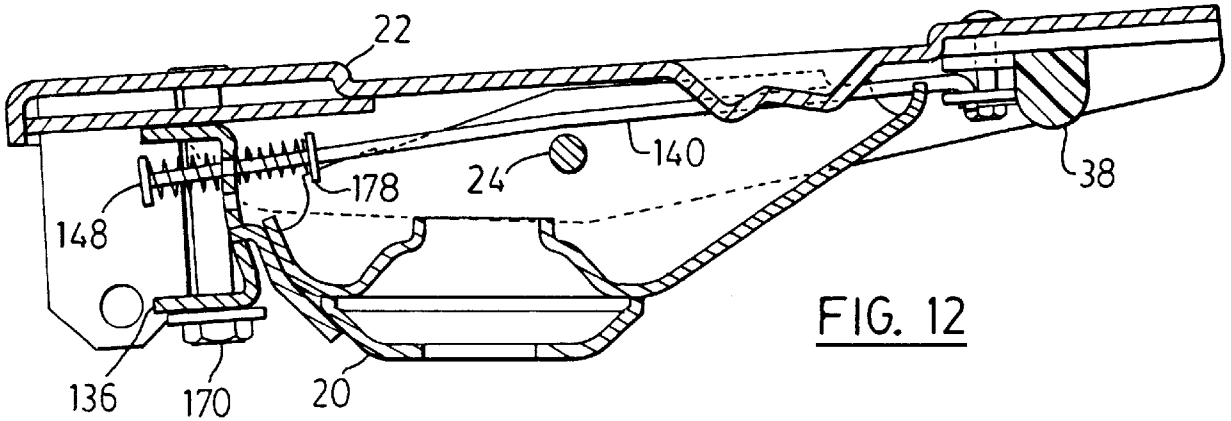
FIG. 12 is a cross-sectional view along the lines 12—12 of FIG. 11.

With the lever 38 in the locking position illustrated in FIGS. 10 to 12, the lever arm 140 is retracted compressing locking spring 142 against locking member arm 136 and relieving unlocking spring 144. If a pair of tongue receiving openings 172 is aligned with forked tongue 132, then the locking member arm will pivot to its locking position with the tongue receiving openings receiving the forked end of the forked tongue 172, as illustrated in FIGS. 10 to 12. With the locking member arm in its locking position, the tilt lock mechanism is locked. If the lever 38 is in its locking position and no pair of tongue receiving openings 172 is aligned with the forked tongue 136, then the locking member arm will simply butt up against the forked end of the tongue 172 until a chair occupant varies the tilt of the chair seat sufficiently to align a pair of tongue receiving openings with the tongue, whereupon the locking member arm will pivot to its locking position.

Figure 14:
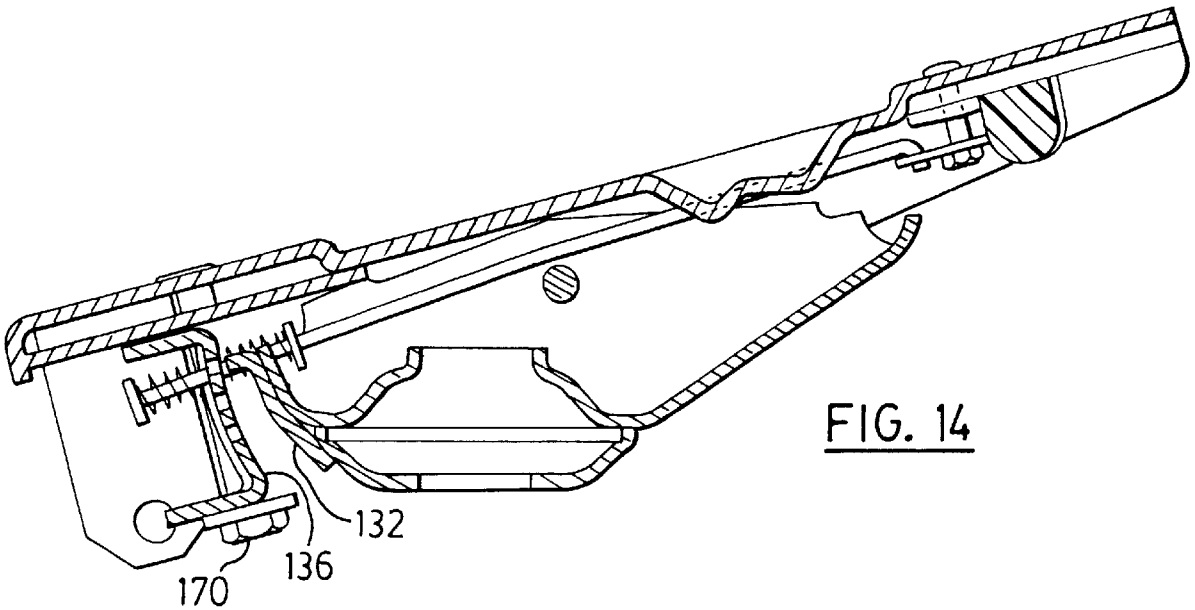
FIG. 14 is a cross-sectional view along the lines 14—14 of FIG. 13.
Figure 13:
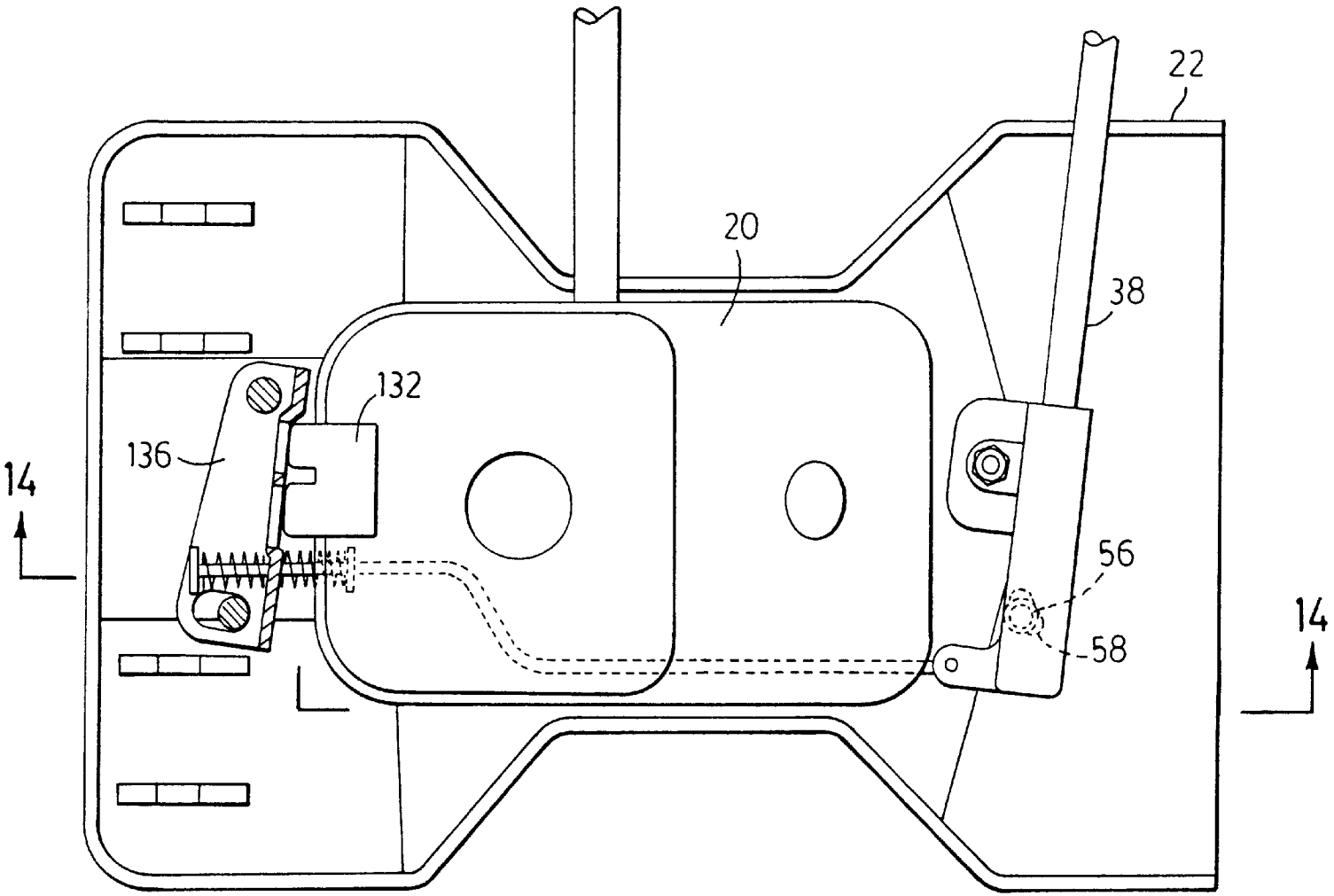
FIG. 13 is a plan view of the tilt lock mechanism shown in FIG. 10 but in an unlocked position.

An occupant may move lever 38 from its locking position of FIGS. 10 to 12 to its unlocking position illustrated in FIGS. 13 and 14 by applying sufficient torque to the lever to compress detent 56 so that it passes over projection 58. In such case, unlocking spring 144 is compressed and locking spring 142 is relieved. This urges the locking member arm to pivot to its unlocking position shown in FIGS. 13 and 14 whereat the locking member arm pivots away from tongue 132 until the end of elongate slot 174 abuts pin 176. With locking member arm 136 in its unlocking position, the tilt lock mechanism is unlocked and an occupant is free to tilt the seat bracket 22 with respect to the post support 20.

From the foregoing, it will be apparent that the occupant may lock in one of several tilt angles with the tilt lock mechanism of FIGS. 10 to 14 by registering different pairs of tongue receiving openings 172 with forked tongue 132. This tilt lock mechanism also has the advantages related in connection with the tilt lock mechanism of FIGS. 1 to 8.

Figure 15:
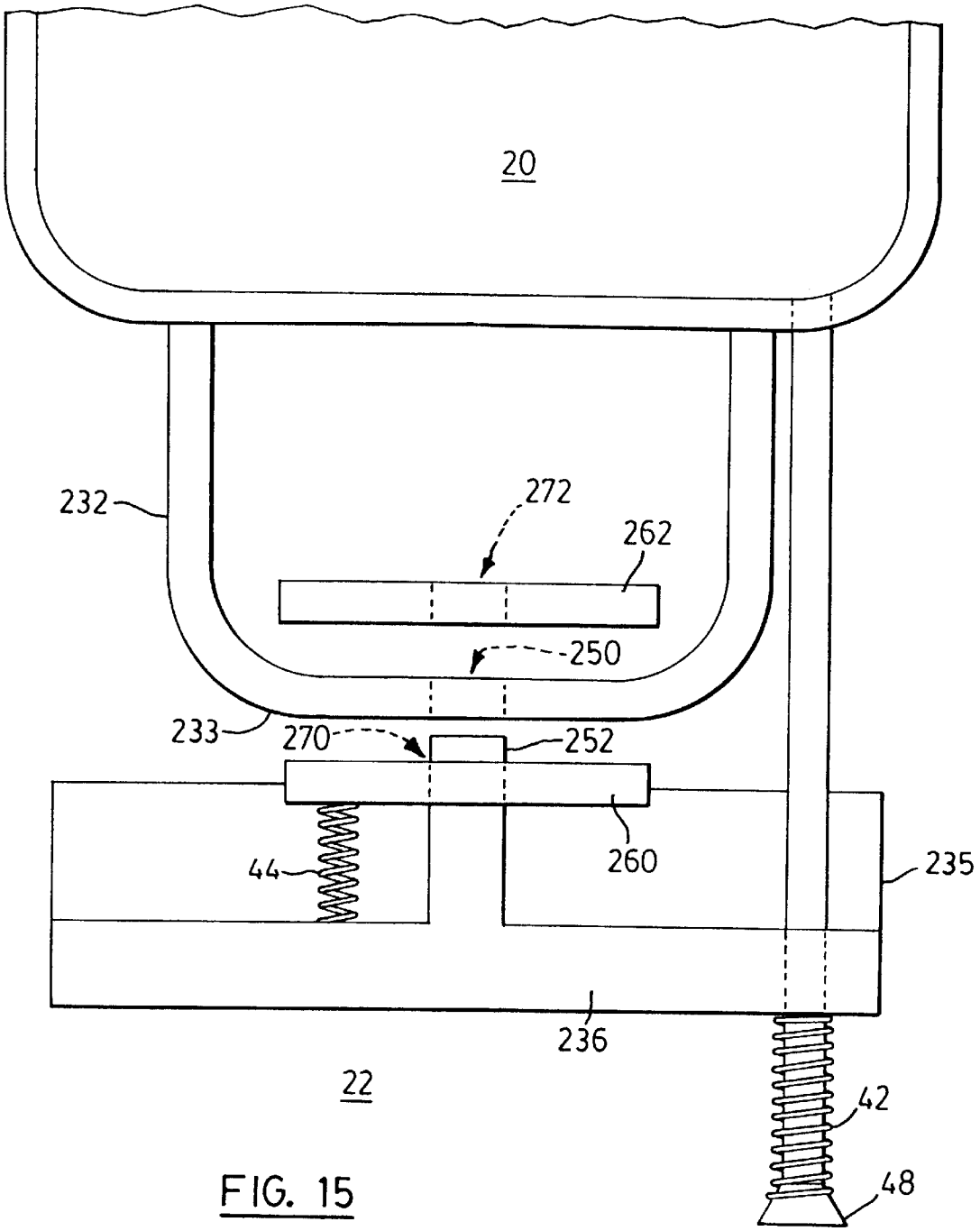
FIG. 15 is a fragmentary plan view of a tilt lock mechanism made in accordance with a further embodiment of this invention, shown in an unlocked position.

In another embodiment illustrated in FIG. 15, the first locking member comprises a U-shaped bracket 232 extending from the chair seat post support 20. The basal wall 233 of this bracket has a number of tongue receiving openings 250. The second locking member comprises a tongue 252 extending from a slider 236 riding on a track 235 on the chair seat bracket 22. A pair of support plates 260, 262 depend from the chair seat post support 22, one on either side of the basal wall 233 of the U-shaped bracket 232. Each of the brackets has one tongue receiving opening 270, 272, respectively.

In operation, when the lever (not shown) is moved to an unlocking position, the unlocking spring 44 urges the slider 236 to its unlocking position illustrated in FIG. 15. In the unlocking position, the tongue 252 extends through tongue receiving opening 270.

A user may move the lever from the unlocking position to a locking position, thereby compressing locking spring 42 which urges slider 236 to move. If a tonque receiving opening 250 of bracket 232 is aligned with the tongue 252, then the tongue of the slider will slide through this opening and, as well, through tongue receiving opening 272 of support post 262 (which opening is spatially fixed in alignment with the tongue 252). With the tongue 252 received through tongue receiving openings 270, 272 of support posts 260, 262, respectively, the tongue is firmly supported and even significant forces on bracket 232 will not damage the tongue. Bracket 232 is provided with several tongue receiving openings so that the chair may be locked at different tilt angles.

While in the embodiments illustrated, the first locking member extends from the chair post support 20 and the second locking member is carried by the chair seat bracket 22, this arrangement could equally be reversed in which case, preferably, the lever 38 is also carried by the chair seat post support 20 rather than the chair seat bracket 22. Similarly, while the detent is shown extending from the lever 38 and the opposing protrusion extending from seat bracket 22, this too could be reversed so that the detent extended from the seat bracket 22.

While the chair illustrated in FIG. 1 is designed to tilt backwardly from a horizontal position, it could equally be designed to tilt forwardly from a horizontal position. Also, the fork in tongue 132 while preferred, is not necessary.

Other modifications will be apparent to those skilled in the art and, therefore, the invention is defined in the claims.

What is claimed is:

1. A chair tilt lock mechanism, comprising:

a chair seat post support;

a chair seat bracket tiltably mounted to said chair seat post support;

a first locking member extending from one of said chair seat post support and said chair seat bracket;

second locking member mounted on another of said chair seat post support and said chair seat bracket and moveable between a locking position whereat said first locking member and said second locking member prevent said chair seat bracket from tilting with respect to said chair seat post support and an unlocking position whereat said first locking member and said second locking member permit said chair seat bracket to tilt with respect to said chair seat post support;

an actuator assembly for moving said second locking member, said actuator assembly comprising a locking spring arranged so as to urge said second locking member to said locking position when compressed and an unlocking spring arranged so as to urge said second locking member to said unlocking position when compressed.

2. The chair tilt lock mechanism of claim 1 wherein said locking spring abuts said second locking member on one side thereof and said unlocking spring abuts said second locking member on a side thereof opposite said locking spring.

3. The chair tilt lock mechanism of claim 2 wherein said actuator assembly comprises a reciprocating link arm with a backstop for said locking spring so as to sandwich said locking spring between said locking spring backstop and said second locking member.

4. The chair tilt lock mechanism of claim 3 wherein said reciprocating link arm also has a backstop for said unlocking spring so as to sandwich said unlocking spring between said unlocking spring backstop and said second locking member.

5. The chair tilt lock mechanism of claim 1 wherein said first locking member comprises a tongue rigidly extending from said one of said chair seat post support and said chair seat bracket and wherein said second locking member comprises an arm having at least one tongue receiving opening.

6. The chair tilt lock mechanism of claim 5 wherein said locking member arm has a plurality of tongue receiving openings each, when receiving said tongue, locking said chair seat bracket at a different tilt angle with respect to said chair seat base.

7. The chair tilt lock mechanism of claim 6 wherein said locking member arm is pivotably mounted to said other of said chair seat post support and said chair seat bracket.

8. The chair tilt lock mechanism of claim 5 wherein said locking spring abuts said locking member arm on one side thereof and said unlocking spring abuts said locking member arm on a side thereof opposite said locking spring.

9. The chair tilt lock mechanism of claim 8 wherein said actuator assembly comprises a reciprocating link arm with a backstop for said locking spring so as to sandwich said locking spring between said locking spring backstop and said locking member arm.

10. The chair tilt lock mechanism of claim 9 wherein said reciprocating link arm also has a backstop for said unlocking spring so as to sandwich said unlocking spring between said unlocking spring backstop and said locking member arm.

11. The chair tilt lock mechanism of claim 1 wherein said first locking member comprises an abutment rigidly extending from said one of said chair seat post support and said chair seat bracket and said second locking member comprises a slider slidably mounted to said other of said chair seat post support and said chair seat bracket for sliding between said locking position whereat said slider is in blocking relation with said abutment so that said slider blocks said chair seat bracket from tilting and said unlocking position whereat said slider is not in blocking relation with said abutment so that said slider does not block said chair seat bracket from tilting.

12. The chair tilt lock of claim 11 wherein said locking spring abuts said slider so as to urge said slider to said locking position when compressed.

13. The chair tilt lock of claim 12 wherein said unlocking spring abuts said slider on a side thereof opposite to said locking spring so as to urge said slider to said unlocking position when compressed.

14. The chair tilt lock mechanism of claim 13 wherein said actuator assembly comprises a reciprocating link arm with a backstop for said locking spring so as to sandwich said locking spring between said locking spring backstop and said slider.

15. The chair tilt lock mechanism of claim 1 wherein said actuator assembly comprises a reciprocating link arm with a backstop for said locking spring so as to sandwich said locking spring between said locking spring backstop and said second locking member.

16. The chair tilt lock mechanism of claim 1 wherein said actuator assembly comprises a reciprocating link arm with a backstop for said unlocking spring so as to sandwich said unlocking spring between said unlocking spring backstop and said second locking member.

17. A chair tilt lock mechanism, comprising:

a chair seat post support;

a chair seat bracket tiltably mounted to said chair seat post support;

a first locking member extending from one of said chair seat post support and said chair seat bracket;

a second locking member mounted on another of said chair seat post support and said chair seat bracket and moveable between a locking position whereat said first locking member and said second locking member prevent said chair seat bracket from tilting with respect to said chair seat post support and an unlocking position whereat said first locking member and said second locking member permit said chair seat bracket to tilt with respect to said chair seat post support;

an actuator for moving said second locking member, said actuator comprising a locking spring arranged so as to urge said second locking member to said locking position, when compressed.

18. The chair tilt lock mechanism of claim 17 wherein said locking spring abuts said second locking member on one side thereof and wherein said actuator further comprises an unlocking spring abutting said second locking member on a side thereof opposite said locking spring so as to urge said second locking member to said unlocking position.

19. The chair tilt lock mechanism of claim 18 wherein said actuator comprises a reciprocating link arm with a backstop for said locking spring so as to sandwich said locking spring between said locking spring backstop and said second locking member.

20. The chair tilt lock mechanism of claim 19 wherein said reciprocating link arm also has a backstop for said unlocking spring so as to sandwich said unlocking spring between said unlocking spring backstop and said second locking member.

21. A chair tilt lock mechanism, comprising:

a chair seat post support;

a chair seat bracket tiltably mounted to said chair seat post support;

a tongue rigidly extending from one of said chair seat post support and said chair seat bracket;

an arm having at least one tongue receiving opening mounted on another of said chair seat post support and said chair seat bracket and moveable between a locking position whereat said tongue and said arm prevent said chair seat bracket from tilting with respect to said chair seat post support and an unlocking position whereat said tongue and said arm permit said chair seat bracket to tilt with respect to said chair seat post support; and an actuator for moving said arm comprising a locking spring arranged for urging said arm to said locking position, when compressed.

22. The chair tilt lock mechanism of claim 21 wherein said arm has a plurality of tongue receiving openings each, when receiving said tongue, locking said chair seat bracket at a different tilt angle with respect to said chair seat base.

23. The chair tilt lock mechanism of claim 22 wherein said arm is pivotably mounted to said other of said chair seat post support and said chair seat bracket.

24. The chair tilt lock mechanism of claim 22 wherein said locking spring abuts said arm on one side thereof and wherein said actuator further comprises an unlocking spring abutting said arm on a side thereof opposite said locking spring so as to urge said arm to said unlocking position.

25. The chair tilt lock mechanism of claim 24 wherein said arm is a locking member arm and said actuator comprises a reciprocating link arm with a backstop for said locking spring so as to sandwich said locking spring between said locking spring backstop and said locking member arm.

26. The chair tilt lock mechanism of claim 25 wherein said reciprocating link arm also has a backstop for said unlocking spring so as to sandwich said unlocking spring between said unlocking spring backstop and said locking member arm.

* * * * *

UNITED STATES PATENT AND TRADEMARK OFFICE

CERTIFICATE OF CORRECTION

PATENT NO. : 6,378,943 B1 
DATED : April 30, 2002
INVENTOR(S) : Ken A. Beggs and Gerard J. Matern It is certified that error appears in the above-identified patent and that said Letters Patent is hereby corrected as shown below:

Column 6,
Line 13, "second locking member" should read as -- a second locking member --.

Signed and Sealed this

Twenty-third Day of July, 2002

*Attest:*

*Attesting Officer*

JAMES E. ROGAN
*Director of the United States Patent and Trademark Office*